US008759726B2

(12) United States Patent
Ross et al.

(10) Patent No.: US 8,759,726 B2
(45) Date of Patent: Jun. 24, 2014

(54) DYNAMIC POWER SPLITTER

(75) Inventors: Art Ross, Stoney Creek (CA); George Feilders, Beaconsfield (CA); Sébastien Roy, Vaudreuil-Dorion (CA); Jules Gauthier, Laval (CA); Ramin Deban, Côte St-Luc (CA); Cevdet Akyel, Montreal (CA)

(73) Assignee: SCP Science, Baie d'Urfe, Quebec (CA)

( * ) Notice: Subject to any disclaimer, the term of this patent is extended or adjusted under 35 U.S.C. 154(b) by 1239 days.

(21) Appl. No.: 12/332,951

(22) Filed: Dec. 11, 2008

(65) Prior Publication Data

US 2009/0152262 A1 Jun. 18, 2009

Related U.S. Application Data

(63) Continuation of application No. 11/638,567, filed on Dec. 14, 2006, now abandoned.

(51) Int. Cl.
*H05B 6/74* (2006.01)
*H01P 5/12* (2006.01)

(52) U.S. Cl.
USPC ..... 219/646; 219/690; 219/746; 333/100

(58) Field of Classification Search
CPC ..... H01P 5/12
USPC ..... 219/600–677, 745, 746; 399/336; 333/113–137, 100
See application file for complete search history.

(56) References Cited

U.S. PATENT DOCUMENTS

2003/0205576 A1* 11/2003 Drozd et al. ..... 219/746
2009/0002092 A1* 1/2009 Panaghiston ..... 333/100

* cited by examiner

*Primary Examiner* — Quang Van
(74) *Attorney, Agent, or Firm* — Norton Rose Fulbright Canada LLP

(57) ABSTRACT

There is described a power splitter for directing electromagnetic power comprising: an input port for receiving the electromagnetic power; at least one dielectric element placed inside the power splitter; at least two output ports for outputting the power according to a splitting ratio, the at least two output ports placed on a surface opposite to the input port; and at least one dielectric moving device for positioning the at least one dielectric element between the at least two output ports to dynamically direct the power into the at least two output ports according to the power splitting ratio.

8 Claims, 8 Drawing Sheets

DYNAMIC POWER SPLITTER

CROSS-REFERENCE TO RELATED APPLICATIONS

The present application claims benefit under 35 U.S.C. 120 and is a continuation of U.S. patent application Ser. No. 11/638,567, filed Dec. 14, 2006 now abandoned, the contents of which are hereby incorporated by reference.

BACKGROUND OF THE INVENTION

1) Field of the Invention

The invention relates to microwave-assisted heating, and more particularly, to systems for microwave processing of a plurality of laboratory samples.

2) Description of the Prior Art

Most chemical reactions either require or benefit from the application of heat. Developments have provided for the use of microwave heating instead of typical Bunsen burners or "hot plates". The use of microwave energy is known to be quite appropriate for many chemical reactions. Microwave heating represents the use of radiation energy at wavelengths residing in the electromagnetic spectrum, or between the far infrared and the radio frequency (from about one millimeter (mm) to about 30 centimeters (cm) wavelengths, or with corresponding frequencies in the range of about 1 to 300 gigahertz (GHz)). The exact upper and lower limits defining "microwave" radiations are somewhat arbitrary.

Microwave radiation is widely used in several fields like spectroscopy, communication, navigation, medicine, and heating. Substances that respond quite well by increasing their temperature levels when under microwave radiation usually have a high dielectric absorption. The use of microwave heating in laboratories is known to people skilled in the art and is often referred to as "microwave assisted" chemistry. A number of laboratory microwave heating devices are thus commercially available. These microwave heating devices typically use a magnetron as the microwave source, a waveguide (usually hollow circular or rectangular metal tube of uniform cross section) to guide the microwaves, and a resonator (sometimes also referred to as the "cavity") into which the microwaves are directed to heat a sample. The microwave source can also be a Klystron, traveling wave tubes, oscillators, and certain semiconductor devices. Most devices use magnetrons, however, as these are simple and economical. One disadvantage of magnetrons is that the control of radiation power directed towards a specific sample inserted inside a resonator is somewhat complex. One known method of controlling the radiation of the magnetron is to run it at its designated constant power while turning it on and off on a cyclical basis in order to have a certain temperature control of the sample(s) located inside separate containers or loads made of a microwave transparent material such as some types of glass, plastic or ceramic. Usually, for convenience, only one load is monitored within the group of loads each containing a sample, the remaining loads estimated to behave somewhat similarly. This leads to large amounts of uncertainty as to the evolution of reactions inside other loads, since even when a "stirring" device can produce quite uniform radiation inside the cavity of a microwave heater, several other factors, such as the presence of samples and sample containers in the microwave oven, can also change the interference pattern within the cavity and thus affect the energy distribution inside the cavity.

Accordingly, when multiple samples are to be treated under one microwave source, the treatment should be uniform and controllable. Hence, there is a need to provide for the ability to vary the radiation power levels sent to each sample using a limited number of microwave sources in order to maintain low costs and high efficiency. There is also a need to be able to precisely know and control the temperature or amount of radiation power sent to each individual sample.

SUMMARY OF THE INVENTION

There is described herein a system wherein a single microwave source is cascaded with microwave splitters and applicators such that a precise control of radiation power is offered to each sample placed within a vessel, alternatively referred to as a load. Stepper motors and feedback mechanisms are used to control each microwave splitter according to a desired end result. While the cascading provides the ability to use only one microwave source for a group of multiple loads, the control of the microwave splitters offers the ability to precisely direct a certain amount of radiation power to the subsequent level of microwave splitters, until the cascade reaches an end characterized by an applicator dedicated to an individual load. The amount of power reaching the end of the cascade is therefore precisely known and controllable.

According to one aspect of the present invention, there is provided an apparatus for microwave heating comprising: a microwave source for generating electromagnetic radiation; a first microwave radiation splitter connected to the microwave source via an input port and having at least two output ports for outputting the electromagnetic radiation received at the input port; at least one dielectric element placed inside the first microwave radiation splitter between the at least two output ports and adapted to dynamically direct the electromagnetic radiation received at the input port to the at least two output ports according to a power splitting ratio; and a load connected to each of the at least two output ports for receiving the electromagnetic radiation.

According to another aspect of the present invention, there is provided a method for directing electromagnetic power from an input port to at least two output ports in a power splitter, the method comprising: providing at least one dielectric element inside the power splitter; receiving the power at an input port; positioning the at least one dielectric element between the at least two output ports to dynamically direct the power thereto according to a power splitting ratio; and outputting the power to the at least two output ports in accordance with the power splitting ratio.

According to yet another aspect of the present invention, there is provided a power splitter for directing electromagnetic power comprising: an input port for receiving the electromagnetic power; at least one dielectric element placed inside the power splitter; at least two output ports for outputting the power according to a splitting ratio, the at least two output ports placed on a surface opposite to the input port; and at least one dielectric moving device for positioning the at least one dielectric element between the at least two output ports to dynamically direct the power into the at least two output ports according to the power splitting ratio.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE INVENTION

Figure 1:
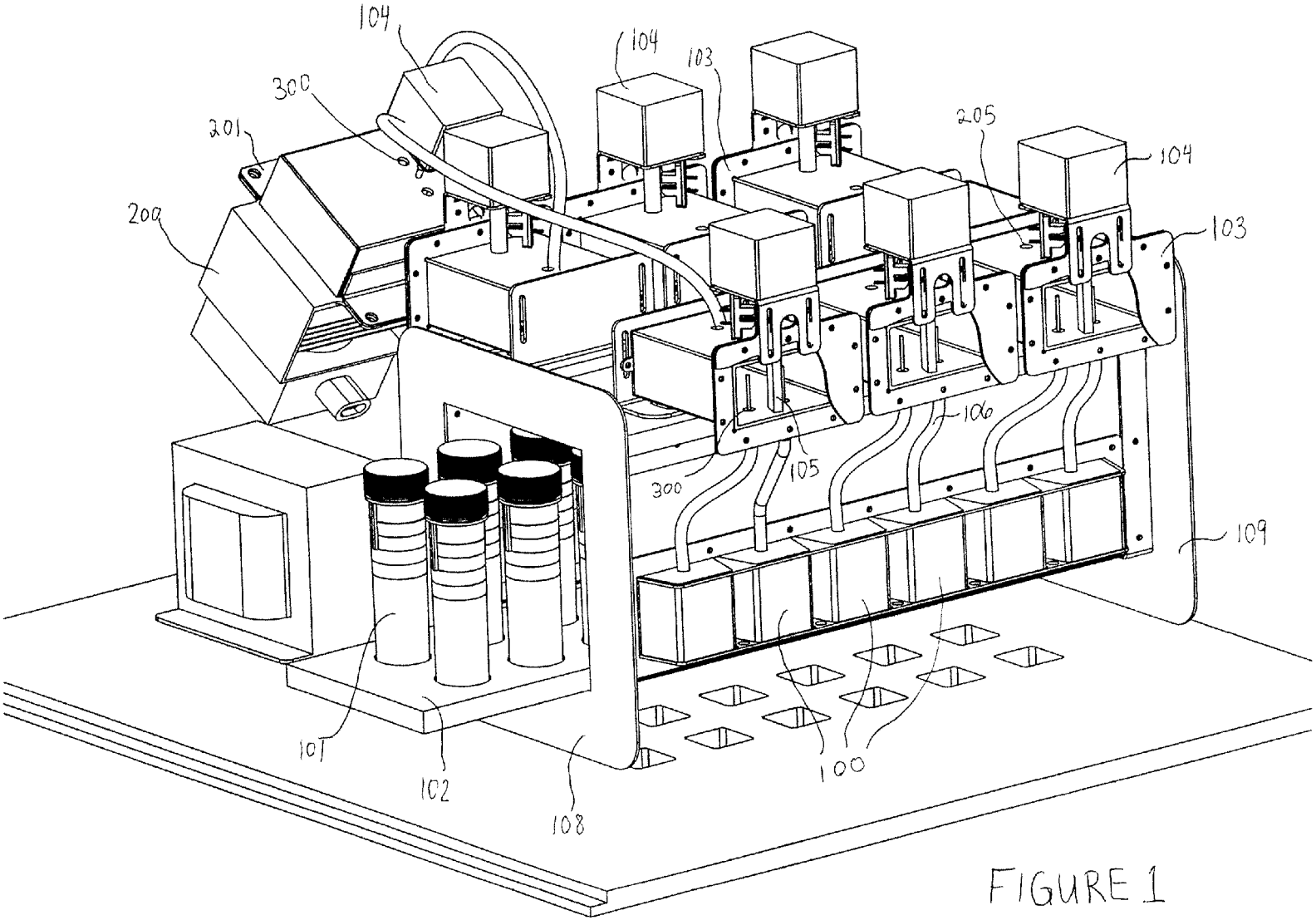
FIG. 1. shows a microwave heating device according to a first embodiment of the invention.

Referring to FIG. 1, and according to an embodiment of the present invention, a rack 102 containing twelve vessels 101 (herein referred to as loads containing sample mixtures for example) is inserted inside the microwave-assisted processing system made of a metal tunnel-shaped cavity through microwave-safe doors 108 and 109. Twelve applicators 100 are used to direct the heat to the loads 101 individually. The applicators are to be understood as being energy directing devices that transmit the energy to the loads, like antennas. The applicators are optional to the system but are used in the embodiment described herein. Multiple applicators can be connected together to redirect the energy in a desired direction to a desired destination. In the embodiment shown in the figure, six applicators 100 are located on each side of the microwave-assisted processing system such that each is placed at the corresponding position of a load 101 once the rack 102 is placed inside the system. The loads 101 can be in vessels made of various microwave transparent materials depending on the sample type and mixture. Examples of possible materials include but are not limited to some types of glass, plastic, ceramic, or more specifically, quartz and Perfluoroalkoxy (PFA). The position of the applicators along with the inserted loads 101 is determined during fabrication using a network analyzer for example. Once the rack 102 containing the loads 101 is inserted inside the cavity, the loads 101 are automatically in their correct positions with respect to the applicators 100. Each applicator 100 receives radiation energy according to a splitting ratio of a variable microwave radiation splitter 103. A coaxial cable 106 connected to one of the two output ports 300 of the variable microwave radiation splitter 103 (also referred to as a secondary microwave radiation splitter) is used to transmit the radiation energy from the output port of the splitter 103 to the applicator 100, as determined by the control of a stepper motor 104 located on each variable microwave radiation splitter 103.

According to the illustrated embodiment of FIG. 1, since there are six loads to be heated on each side of the system, each pair of loads being controlled by a single variable microwave radiation splitter 103 with its stepper motor 104, there are thus six variable microwave radiation splitters 103 and stepper motors 104. In a preferred embodiment, only one exhaust fan is installed on the cavity (not shown) in order to release unwanted fumes in case a vessel breaks inside the cavity, but more than one may be present. Other safety features can also be added to prevent vessel rupture and operator harm. Each variable microwave radiation splitter 103 receives radiation energy from one of the two outputs of another variable microwave radiation splitter 201, itself controlled by another stepper motor 104. The variable microwave radiation splitter 201 is for splitting the power received from a source of microwave radiation 200, herein shown as a magnetron.

Figure 2A:
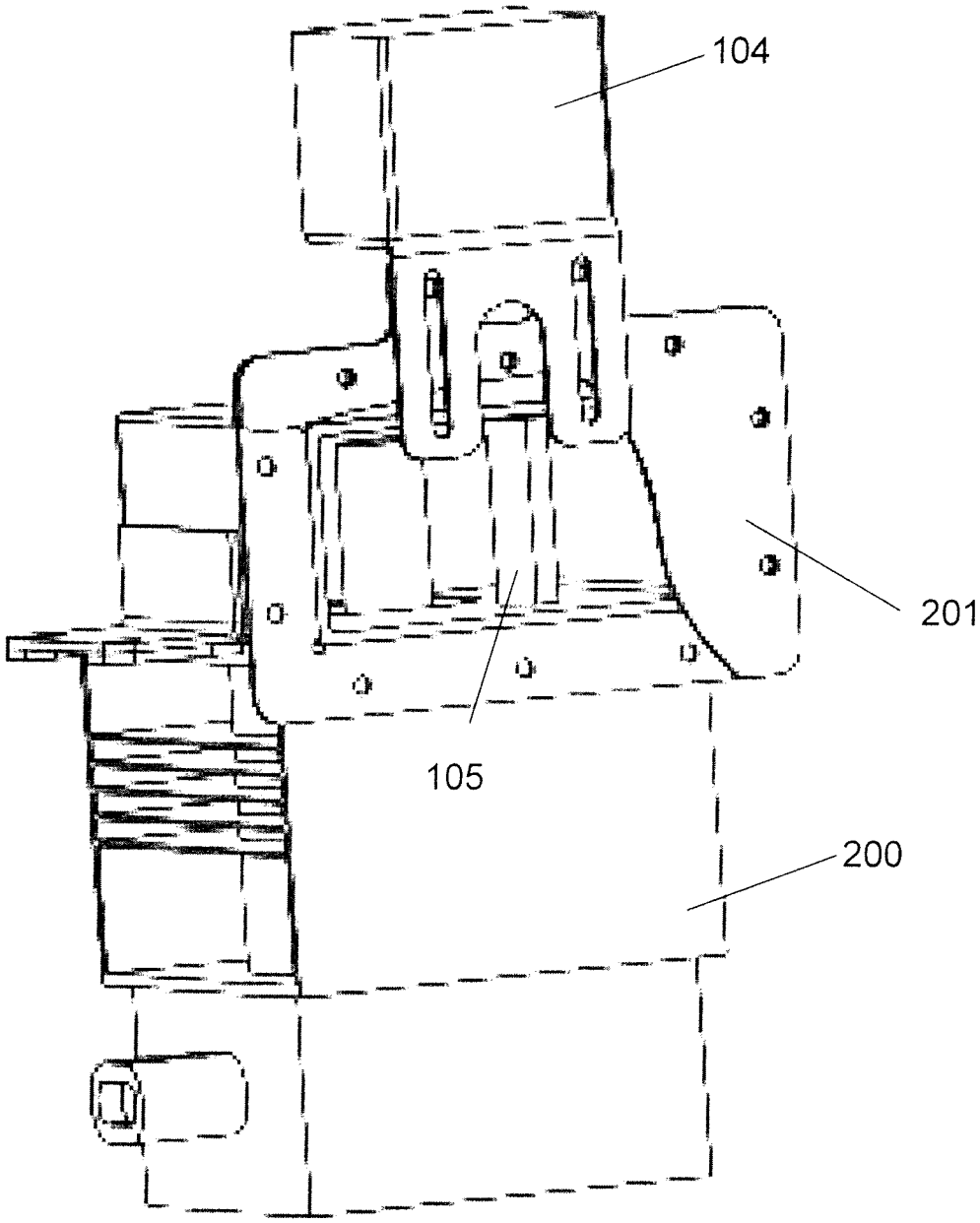
FIG. 2*a* shows a microwave source with a primary microwave splitter and a stepper motor according to an embodiment of the present invention.
Figure 2B:
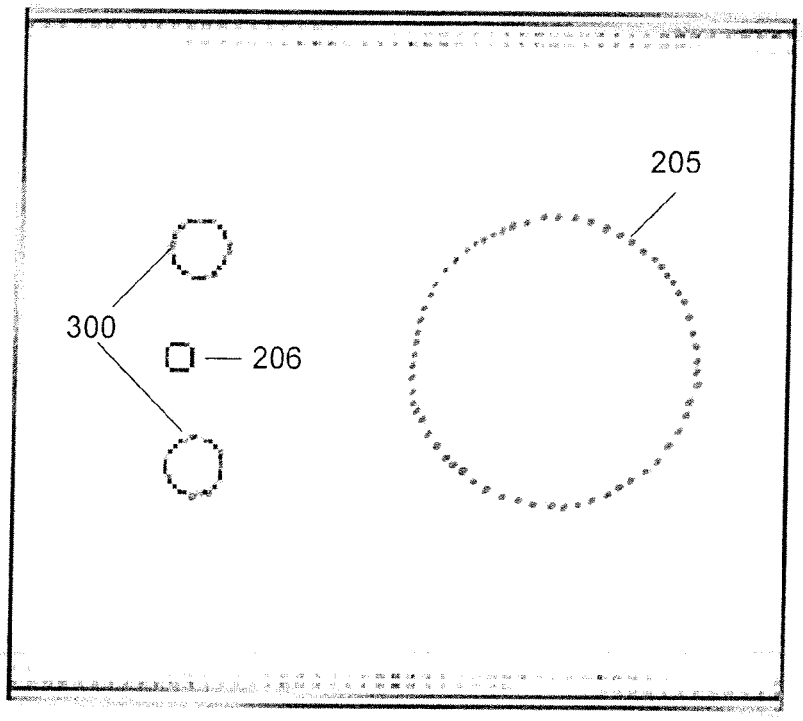
FIG. 2*b* shows a top view of the cavity of the primary microwave splitter of FIG. 2*a* in accordance with an embodiment of the invention.
Figure 2C:
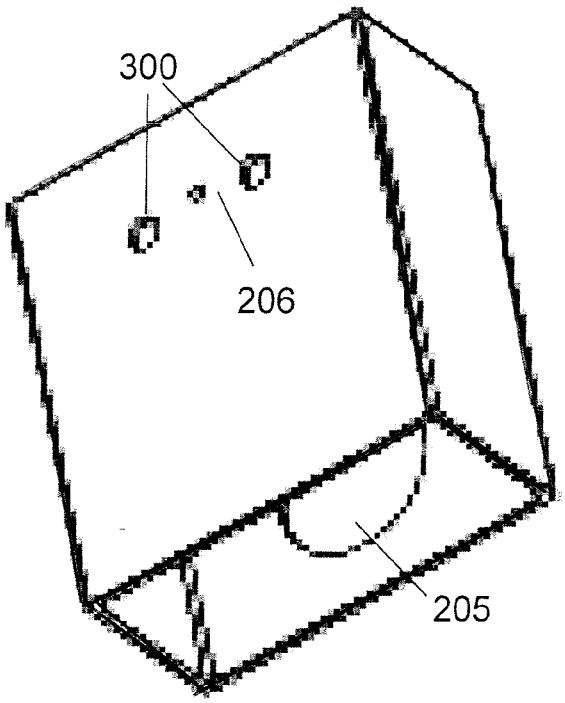
FIG. 2*c* shows a perspective view of the cavity of the primary microwave splitter of FIG. 2*a* in accordance with an embodiment of the invention.

More particularly, and referring to FIG. 2*a*, the source of microwave radiation 200, is mounted on a variable microwave radiation splitter 201. The variable microwave radiation splitter 201 is also dynamically controlled by a stepper motor 104 with a feedback signal coming from temperature monitoring of samples 101. For example, temperature feedback can be implemented using any temperature sensor, such as IR sensors, located underneath each load. The variable microwave radiation splitter 201 is also referred to as a primary microwave splitter. Referring to FIG. 2*b*, variable microwave radiation splitter 201 performs a first division of the radiation energy of the microwave source 200 received at an input port 205 in accordance with a first splitting ratio. Input port 205 is located on one side of the rectangular waveguide forming the variable microwave radiation splitter 201. The radiation energy is then outputted into two output ports 300 located on a second opposite side. The control of the splitting ratio is provided by the stepper motor 104 (shown in FIG. 2*a*), which moves, or rotates, a dielectric element 105 placed inside the rectangular waveguide cavity forming the variable microwave radiation splitter 201, and via the hole or shaft 206. More particularly, the dielectric element 105 is placed and moved between the two output ports 300, and as shown later in FIG. 5.

Figure 3A:
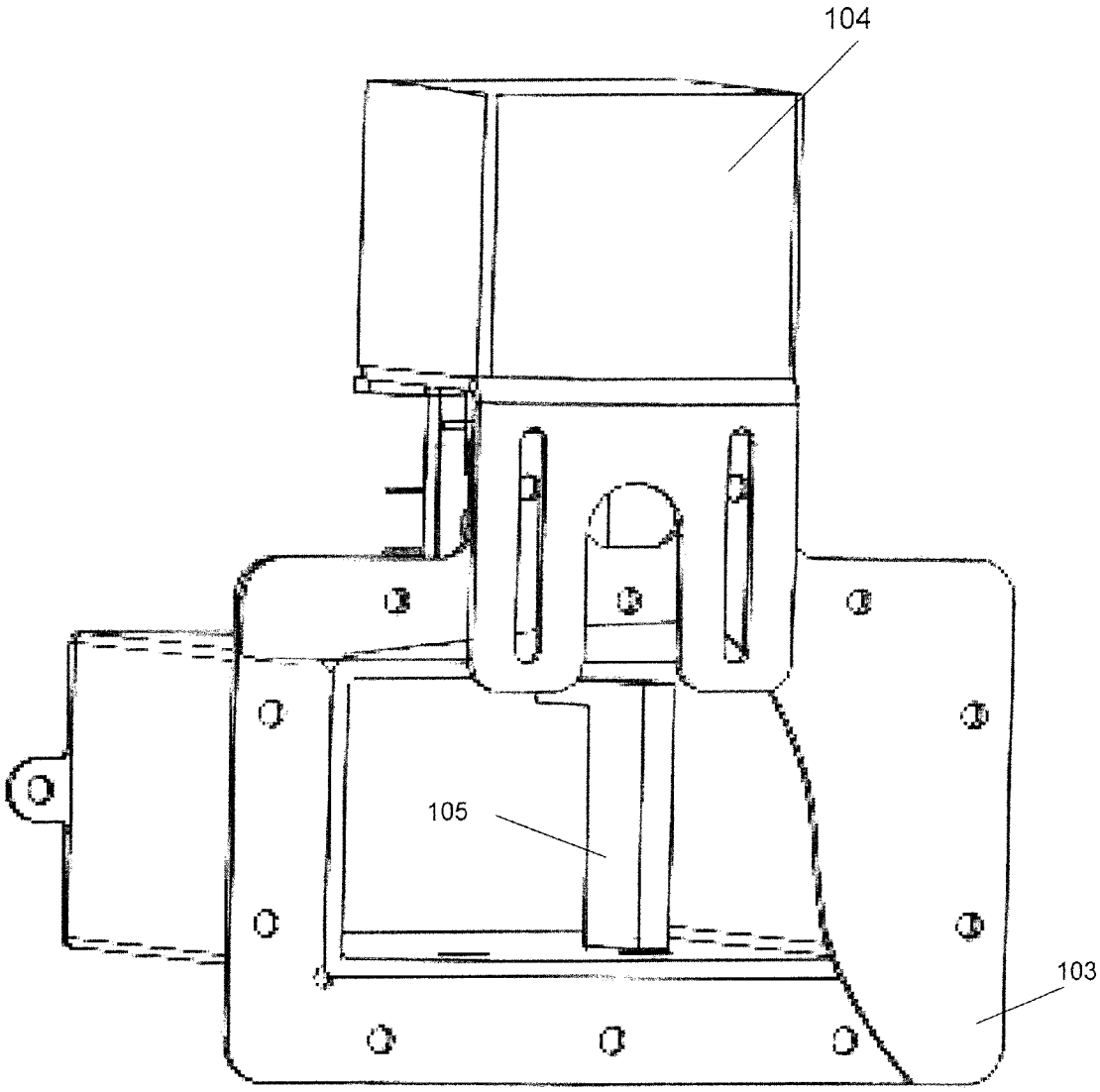
FIG. 3*a* shows a secondary microwave splitter and stepper motor, according to an embodiment of the present invention.
Figure 3C:
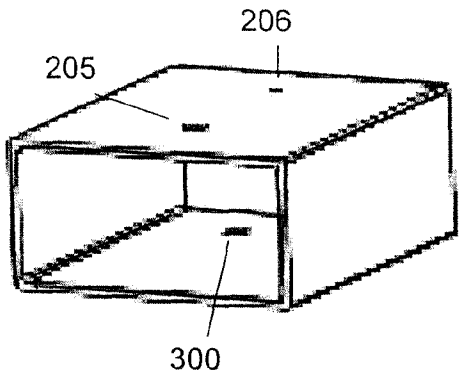
FIG. 3*c* shows a perspective view of the cavity of the secondary microwave splitter of FIG. 3*a* in accordance with an embodiment of the invention.
Figure 3B:
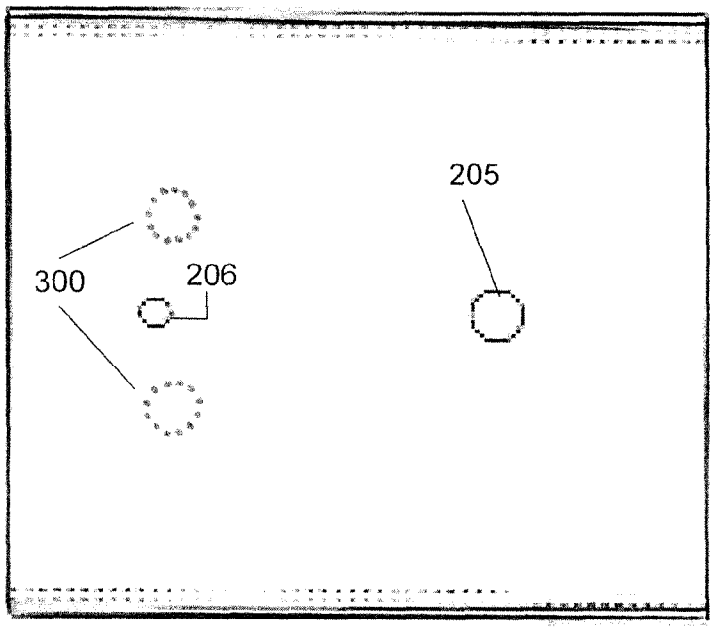
FIG. 3*b* shows a top view of the cavity of the secondary microwave splitter of FIG. 3*a* in accordance with an embodiment of the invention.

FIG. 3*a* shows the variable microwave radiation splitter 103, dynamically controlled by the stepper motor 104. The variable microwave radiation splitter 103 is referred to as a secondary microwave splitter as it performs a second division of the radiation energy from the microwave source in accordance with a second splitting ratio. Radiation energy already split by a first variable microwave radiation splitter (element 201 in FIG. 2*a*) is received at an input port 205 (FIG. 3*b*) located on a first side of the rectangular waveguide forming the variable microwave radiation splitter 103. This power is then split once again according to the second splitting ratio and is directed into two output ports 300 located on a second side opposite to the first side where the input port is located. The control of this second splitting ratio is provided by the associated stepper motor 104, which moves or rotates a dielectric element 105 placed inside the rectangular waveguide cavity forming the variable microwave radiation splitter 103 in the same manner as described above, and via the rotation hole or shaft 206 (FIG. 3*b*).

Figure 4A:
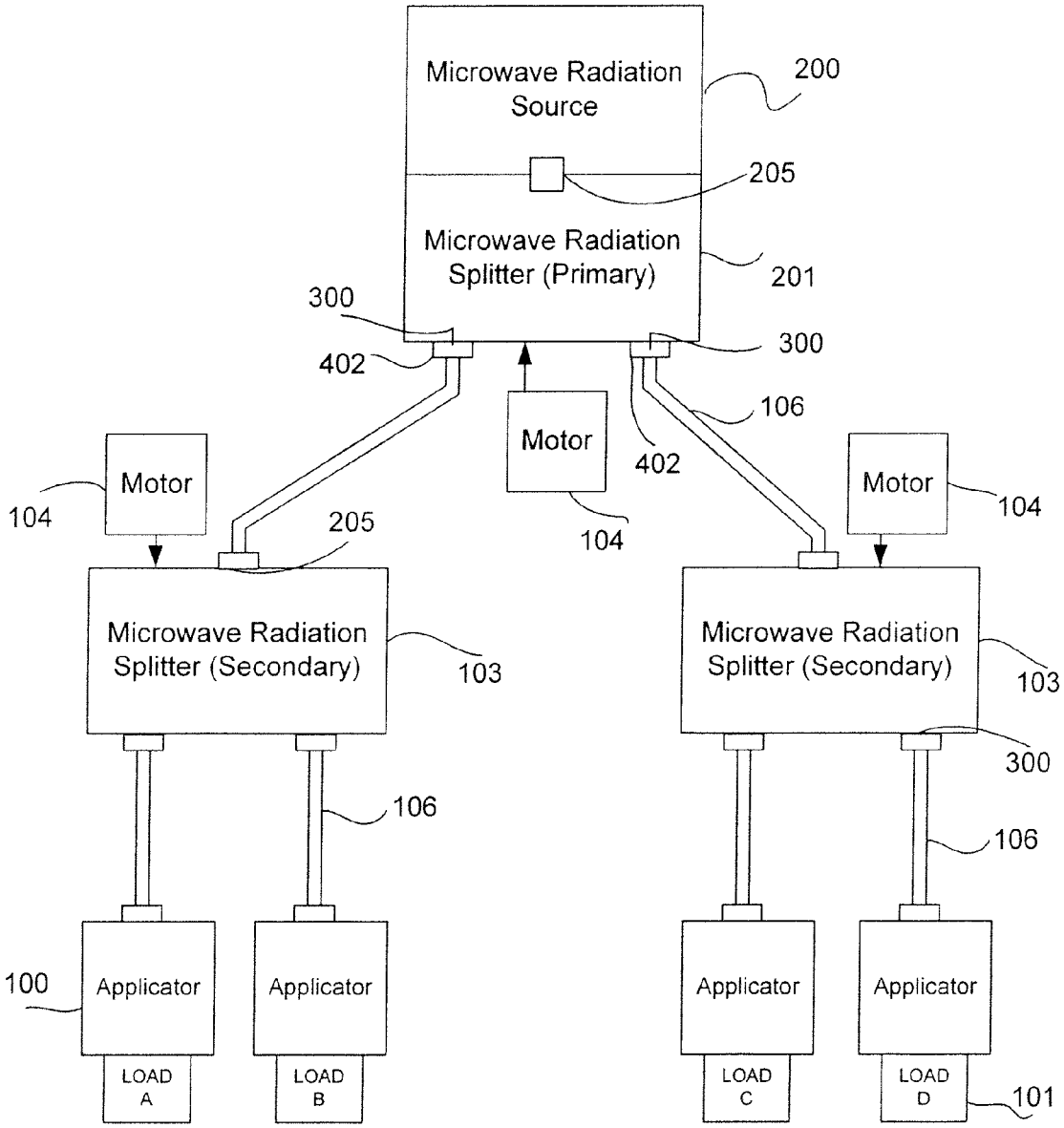
FIG. 4*a* is a schematic illustrating a two-level cascade system in accordance with an embodiment of the invention.

FIG. 4*a* illustrates both primary 201 and secondary 103 microwave radiation splitters as they are assembled inside the system according to one embodiment. For each pair of secondary microwave radiation splitters 103, one magnetron 200 connected to a primary splitter 201 communicates radiation energy to each individual secondary splitter 103 via a coaxial connector 106 connected to its two output ports 300 according to a first splitting ratio. This first splitting ratio is controlled by the stepper motor 104 and a feedback mechanism coming from the monitoring of four loads (A, B, C and D for example) in order to treat each pair of loads 101 (A-B, and C-D) as desired. Each secondary splitter 103 communicates part of the received radiation energy to each dedicated applicator 100 and according to a second splitting ratio. This second splitting ratio is controlled by the stepper motor 104 and a feedback mechanism coming from the monitoring of each individual load in order to treat each load 101 within each pair of loads as desired. Insertion sleeves 402 are also used to connect each input and output port to the coaxial cables 106.

Figure 4B:
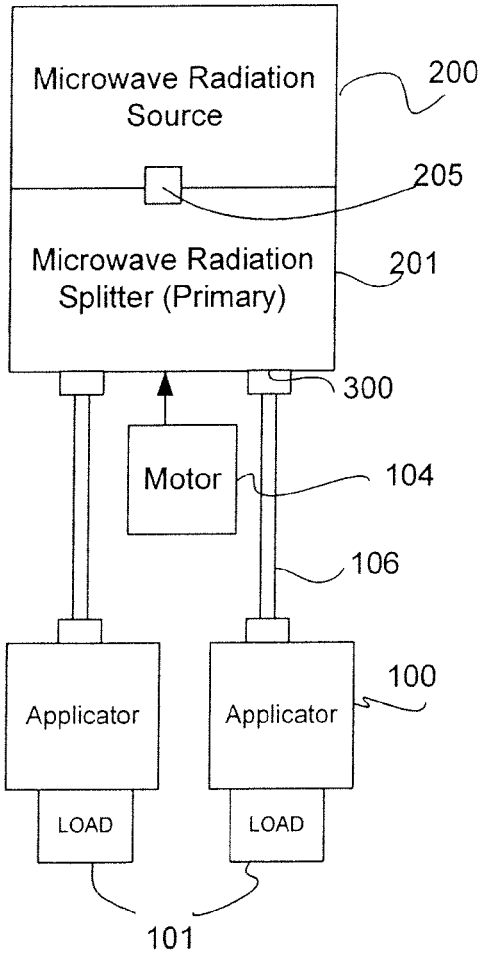
FIG. 4*b* is a schematic illustrating a one-level cascade system in accordance with an embodiment of the invention.

A one-level cascade system consists of two loads 101, one variable microwave radiation splitter 201 and one source of radiation energy 200, as illustrated in FIG. 4*b*. A two-level cascade system, as in FIG. 4*a*, consists of four loads 101, two secondary variable microwave radiation splitters 103, one primary variable microwave radiation splitter 201, and one source of radiation energy 200. The system can also be made of a three-level cascade arrangement or more.

In a two-level cascade arrangement, the difference in temperature between the pair of loads A and B is used to control the splitting ratio of the secondary splitter 103. Similarly, the difference in temperature between the pair of loads C and D is used to control the splitting ratio of the secondary splitter 103. Once the temperatures of the two pairs of loads are as desired and within a given tolerance level, the second splitting ratio of the secondary splitter 201 is dynamically controlled in such a way to achieve a balanced temperature for each of the two pairs of loads; i.e. A and B is one set of temperatures to be compared to C and D for the other set of temperatures. The same principle applies for other groups of four loads; E, F, G and H. Software may be programmed to perform the above-described procedure, as is understood by a person skilled in the art.

Figure 5:
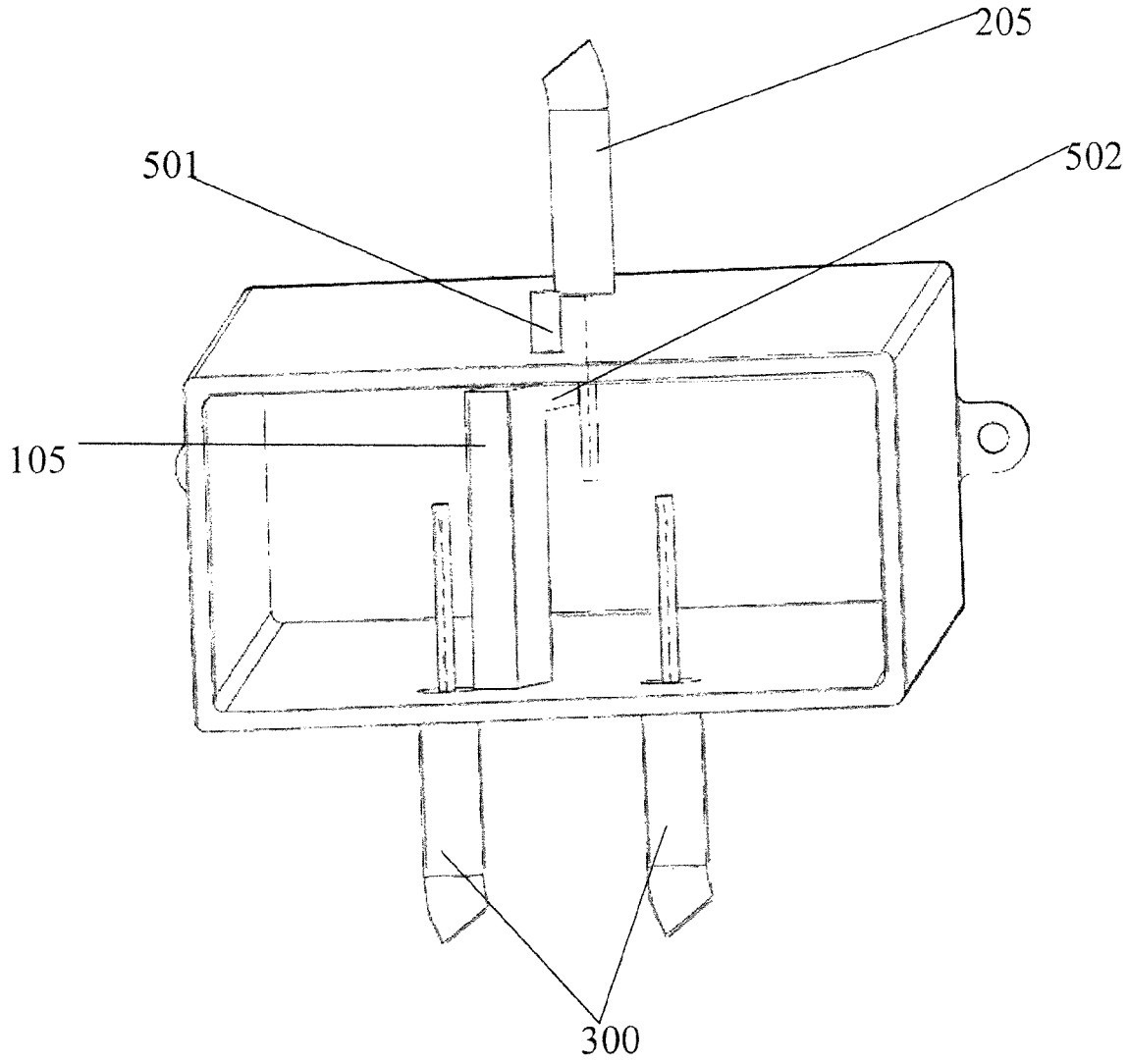
FIG. 5 is a schematic illustrating the position of elements within the cavity of a microwave splitter in accordance with an embodiment of the invention.

Referring to FIG. 5, the dielectric element 105 placed inside variable microwave radiation splitters (201 and 103) can be designed in the shape as illustrated in the drawings or in any other shape to provide for high splitting efficiency. The dielectric element 105 can be made of an aggregate of several different materials with a high permittivity, such as Teflon or alumina. For example, a material made of 99.9% alumina is found to be very effective. When the dielectric element (105) is rotated between the two output ports 300 by the stepper motor 104 up to an angle of 170 degrees, the arrangement provides for up to 5 dB of control in the difference between the radiation power sent to each of the two output ports 300. When the dielectric element 105 is in its original position, i.e. not rotated or in what is referred to as the zero degree position, the dielectric element 105 provides up to a 3 dB difference between the radiation power sent and the two output ports 300. While the positioning of the dielectric element 105 inside the cavity forming the variable microwave radiation splitters (201 or 103) may be varied to change the power splitting ratio, the placement of the input port 205 and output ports 300 will further determine the power splitting efficiency.

FIG. 5 illustrates how all the elements present in the cavity of the microwave splitter are positioned with respect to each other according to an embodiment that provides for a relatively high power splitting efficiency. Various other designs are however possible. For example, the cavity of the microwave splitter (103 or 201) can either be rectangular, square-like or even cylindrical. In one embodiment, the cavity shape can take, for example, a rectangular size 72.14 millimeters (mm) by 34.01 mm, such that it is functional in the S-band of frequencies. Good adaptation and contrasts were also achieved with a length of 72 mm and 75 mm, which may be varied and further depends on the placement of the ports (205, 300) and the dielectric element 105 as well as the shape of the cavity. Hence, the placement of the input 205 and output ports 300 as well as the dielectric element 105 are determinant and can be varied depending on the various specifications needed for the microwave splitter design. For example, still in the S-band of frequencies, good adaptation can be achieved by placing the input port 26 mm from one end of the cavity and 36 mm from a side of the cavity at a height of 24 mm Moreover, in FIG. 5, the dielectric element 105 is rectangular in shape (for example, 5 mm by 10 mm by 32 mm) and placed such that its height extends from a first side of the cavity having an input port 205 to a second side opposite to the first side of the cavity and having the output ports 300. The placement and shape of the dielectric element 105 can be changed. For example, it was found that when the displacement of the dielectric 105 is performed closer to the output ports 300, the contrast between the output powers is better. Also, displacement performed behind the output ports 300 results in a better adaptation. A circular movement or a rotation of the dielectric element 105 around an axis 501 parallel to its height provides for a combination of both higher contrasts and better adaptation. The circular movement can be achieved though the use of an arm 502 connecting the tip of the dielectric element 105 with a directing device or a motor through a hole or shaft 206 following the axis of rotation 501. The hole or shaft 206 does not cause any further coupling effects if the hole is maintained small enough in diameter; for example 1.5 mm.

Both primary and secondary variable microwave radiation splitters (201 and 103) disclosed herein are not limited to controlling heat directed to each load placed within the system. Any embodiment wherein the splitter is used to control a source of radiation energy towards two or more outputs falls within the scope of this invention. More precisely, the variable microwave radiation splitters (201 and 103) disclosed herein are used to control how radiation energy or power is directed between two or more output ports 300. The system and variable microwave radiation splitters (201 and 103) can also function at other frequencies, and is not restricted to using sources that emit at the typical microwave frequency of 2.54 GHz. The microwave radiation source 200 can be any appropriate source, including magnetrons, klystrons, traveling wave tubes, various electronic oscillators and solid states sources including various transistors and diodes. It should also be understood that the displacement of the dielectric may be translational and/or rotational. The shape of the dielectric and the microwave power splitter have been described for optimum performance but may vary depending on the system's requirements.

An embodiment for the power splitter having more than two ports to output the radiation power is, for example, three ports with a single dielectric element positioned in front of a central port, the dielectric element being rotated from a first port to a second port to the third port to split the radiation power three ways according to different proportions. The dielectric element may also be moved in a translational motion instead of a rotational motion, thereby enabling a design with more than two ports and a single dielectric element that can be slid across a surface to correctly divide the radiation power amongst the multiple ports. Another embodiment is to have four ports and two dielectric elements, one dielectric element for each set of two ports. A first set of two ports is positioned at one end of the power splitter with one dielectric therebetween, while a second set of two ports is positioned at another end of the power splitter with the second dielectric therebetween. The person skilled in the art will understand that while the embodiments illustrated in the present figures show two ports and a single dielectric element, many variants exist on this design without deviating from the spirit of the present invention.

The embodiments of the invention described above are intended to be exemplary only. The scope of the invention is therefore intended to be limited solely by the scope of the appended claims.

What is claimed is:

1. An apparatus for microwave heating comprising:

a microwave source for generating electromagnetic radiation;

a first microwave radiation splitter connected to said microwave source via an input port and having at least two output ports for outputting said electromagnetic radiation received at said input port;

at least one dielectric element placed inside said first microwave radiation splitter between said at least two output ports and adapted to dynamically direct said electromagnetic radiation received at said input port to said at least two output ports according to a variable power splitting ratio;

a load connected by a coaxial connector to each of said at least two output ports for receiving said electromagnetic radiation; and a second microwave radiation splitter comprising at least one dielectric element placed inside and adapted to dynamically direct said electromagnetic radiation received at input ports to output ports according to a variable power splitting ratio, said second microwave radiation splitter connected between the first microwave radiation splitter and the load.

2. The apparatus as in claim 1, further comprising an applicator present between each load and output port for directing said electromagnetic radiation to said load.

3. The apparatus as in claim 1, wherein said first microwave radiation splitter comprises a motor for rotating said at least one dielectric element between said at least two output ports.

4. The apparatus as in claim 1, further comprising a sensor for sensing a physical parameter of said load and for providing a feedback mechanism to control said at least one dielectric element.

5. The apparatus as in claim 1, wherein said microwave source is a magnetron.

6. The apparatus as in claim 2, wherein said applicator is connected to each one of said at least two output ports by a coaxial cable.

7. The apparatus as in claim 1, further comprising a third microwave radiation splitter comprising at least one dielectric element placed inside and adapted to dynamically direct said electromagnetic radiation received at input ports to output ports according to a variable power splitting ratio, wherein said third microwave radiation splitters is connected between said first microwave radiation splitter and said load.

8. The apparatus as in claim 1, wherein said power splitter comprises four output ports and two dielectric elements.

* * * * *